US009589532B2

(12) United States Patent
Park et al.

(10) Patent No.: US 9,589,532 B2
(45) Date of Patent: Mar. 7, 2017

(54) DATA DRIVER AND DRIVING METHOD WITH CONTROL OF BIAS CURRENT BASED ON PIXEL IMAGE DATA

(71) Applicant: Samsung Display Co., Ltd., Yongin, Gyeonggi-Do (KR)

(72) Inventors: Suhyeong Park, Gyeongju-si (KR); Hoyong Jung, Seongnam-si (KR)

(73) Assignee: Samsung Display Co., Ltd. (KR)

( * ) Notice: Subject to any disclaimer, the term of this patent is extended or adjusted under 35 U.S.C. 154(b) by 25 days.

(21) Appl. No.: 14/688,752

(22) Filed: Apr. 16, 2015

(65) Prior Publication Data

US 2016/0078841 A1 Mar. 17, 2016

(30) Foreign Application Priority Data

Sep. 16, 2014 (KR) ..... 10-2014-0122847

(51) Int. Cl.

*G09G 5/00* (2006.01)
*G09G 3/20* (2006.01)
*G09G 3/36* (2006.01)

(52) U.S. Cl.

CPC ..... *G09G 5/006* (2013.01); *G09G 3/20* (2013.01); *G09G 3/3685* (2013.01); *G09G 2310/027* (2013.01); *G09G 2310/0289* (2013.01); *G09G 2310/0291* (2013.01); *G09G 2310/0297* (2013.01); *G09G 2330/021* (2013.01)

(58) Field of Classification Search

CPC ..... G09G 5/006; G09G 2310/0294; G09G 2310/0291; G09G 2310/027; G09G 2310/0297; G09G 2310/0289; G09G 2330/021; G09G 3/3685–3/3696

See application file for complete search history.

(56) References Cited

U.S. PATENT DOCUMENTS 8,310,507 B2 11/2012 Hiratsuka
8,466,908 B2 6/2013 Yen
(Continued)

FOREIGN PATENT DOCUMENTS

JP 2012-137571 7/2012
KR 10-2007-0070818 A 7/2007
(Continued)

OTHER PUBLICATIONS

Lee et al.; "A 1.4-Gbps intra-panel interface with low-power and low-EMI schemes for Tablet PC applications"; Journal of the SID 20/12, 2012; pp. 661-668.

*Primary Examiner* — Liliana Cerullo
(74) *Attorney, Agent, or Firm* — Innovation Counsel LLP

(57) ABSTRACT

A data driver includes buffers respectively outputting data voltages corresponding to pixel image data, bias units corresponding to the buffers in a one-to-one correspondence and driving the buffers, respectively, and a global setting part applying control level values to the bias units. Each of the bias units includes a bias signal generating unit that selects one control level value among the control level values based on a corresponding pixel image data among the pixel image data and generates a bias signal having a control level corresponding to the selected control level value and a current generating unit that generates a corresponding bias current in response to the bias signal and applies the corresponding bias current to a corresponding buffer among the buffers.

14 Claims, 15 Drawing Sheets

(56) References Cited

U.S. PATENT DOCUMENTS

| | | | | |
|---|---|---|---|---|
| 2004/0036670 | A1* | 2/2004 | Chung | G09G 3/3688 345/99 |
| 2010/0171731 | A1 | 7/2010 | Tanaka | |
| 2011/0050665 | A1 | 3/2011 | Tsai et al. | |
| 2012/0013587 | A1* | 1/2012 | Yen | G09G 3/3688 345/211 |
| 2013/0307838 | A1* | 11/2013 | Kim | G09G 5/001 345/212 |
| 2016/0049133 | A1* | 2/2016 | Park | G09G 3/3648 345/212 |

FOREIGN PATENT DOCUMENTS

| | | | |
|---|---|---|---|
| KR | 10-2011-0060280 | A | 6/2011 |
| KR | 10-2012-0120517 | A | 11/2012 |
| KR | 10-2014-0003825 | A | 1/2014 |
| KR | 1020150055253 | | 5/2015 |

* cited by examiner

DATA DRIVER AND DRIVING METHOD WITH CONTROL OF BIAS CURRENT BASED ON PIXEL IMAGE DATA

CROSS-REFERENCE TO RELATED APPLICATION

This U.S. non-provisional patent application claims priority under 35 U.S.C. §119 of Korean Patent Application No. 10-2014-0122847, filed on Sep. 16, 2014, the contents of which are hereby incorporated by reference in its entirety.

BACKGROUND

1. Field of Disclosure

The present disclosure relates to a data driver and a method of driving the same. More particularly, the present disclosure relates to a data driver having low power consumption and a method of driving the data driver.

2. Description of the Related Art

In general, a display apparatus includes pixel electrodes, switching devices connected to the pixel electrodes, gate lines, and data lines.

To generate various voltages, the display apparatus includes an AC/DC converter that converts an alternating current voltage source to a direct current voltage source and an analog circuit that converts the direct current voltage source to an analog driving voltage. The analog driving voltage is generated by controlling the voltage level of a reference voltage source using a voltage source regulator and boosting the reference voltage source using a booster circuit, e.g., an electric charge pump.

The analog driving voltage is applied to a data driver used to drive the display apparatus. The data driver generates a data voltage using the analog driving voltage and outputs the data voltage to the data lines through buffers. Power consumption increases when the data driver outputs the data voltage.

SUMMARY

The present disclosure provides a data driver having reduced power consumption and a method of driving the data driver.

Embodiments of the system and method provide a data driver including a plurality of buffers that respectively output data voltages corresponding to pixel image data, a plurality of bias units that correspond to the buffers in a one-to-one correspondence and drive the buffers, respectively, and a global setting part that applies a plurality of control level values to the bias units. Each of the bias units includes a bias signal generating unit that selects one control level value among the control level values based on a corresponding pixel image data among the pixel image data and generates a bias signal having a control level corresponding to the selected control level value and a current generating unit that generates a corresponding bias current in response to the bias signal and applies the corresponding bias current to a corresponding buffer among the buffers.

Embodiments of the system and method provide a method of driving a data driver, including outputting a plurality of data voltages corresponding to pixel image data through a plurality of buffers, respectively, driving the buffers using a plurality of bias units that correspond to the buffers in a one-to-one correspondence, and applying a plurality of control level values to the bias units. Driving the buffers includes selecting one control level value among the control level values based on a corresponding pixel image data among the pixel image data, generating a bias signal having the selected control level value, and generating a bias current in response to the bias signal to apply the bias current to a corresponding buffer among the buffers.

According to the above, the data driver includes the bias units corresponding to the buffers in a one-to-one correspondence and respectively applies the bias currents to the buffers. Thus, the bias currents are controlled in the unit of buffer according to the variation in amount of the data voltages output from the buffers in each horizontal period. As a result, the power consumption of the buffers may be reduced.

BRIEF DESCRIPTION OF THE DRAWINGS

The above and other advantages of the present disclosure are described with reference to the accompanying drawings wherein.

DETAILED DESCRIPTION

Figure 1:
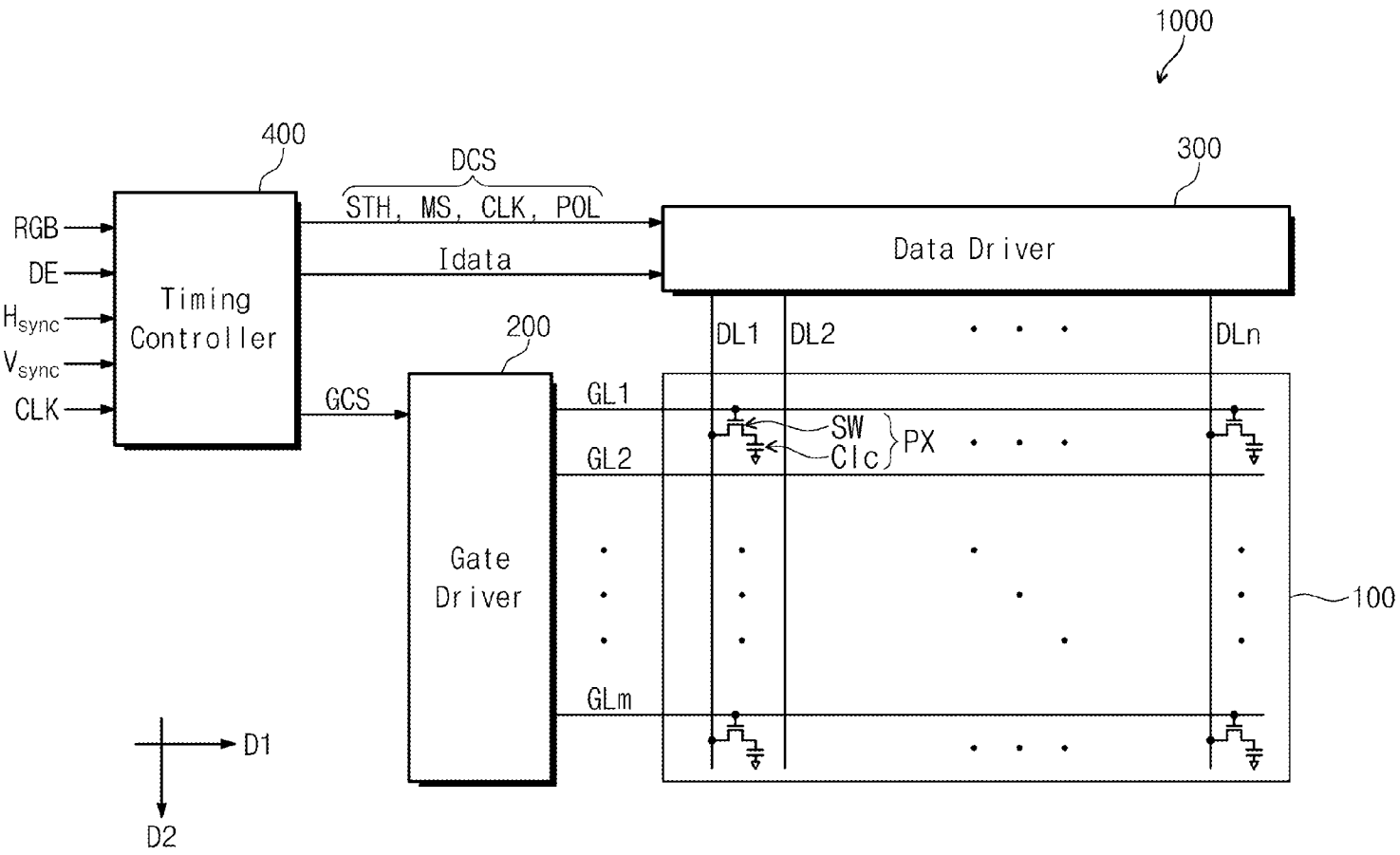
FIG. 1 is a block diagram showing a display apparatus according to an exemplary embodiment of the present disclosure.

When an element or layer is referred to as being "on", "connected to" or "coupled to" another element or layer, it may be directly on, connected or coupled to the other element or layer, or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

Although the terms "first," "second," etc. may be used herein to describe various elements, components, regions, layers and/or sections, these elements, components, regions, layers and/or sections are not limited by these terms. These terms are only used to distinguish one element, component, region, layer or section from another region, layer or section. Thus, a first element, component, region, layer or section discussed below may also be referred to as a second element, component, region, layer or section without departing from the teachings of the present system and method.

Spatially relative terms, such as "beneath", "below", "lower", "above", "upper" and the like, may be used herein for ease of description to describe one element or feature's relationship to another element(s) or feature(s) as illustrated in the figures. The spatially relative terms, however, are also intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" may be construed to mean "above," depending on the orientation of the device relative to that shown in the figures. Accordingly, the spatially relative descriptors used herein are to be interpreted accordingly relative to the orientation shown in the figures.

The terminologies used herein for describing the particular embodiments are not intended to be limiting of the present system and method. As used herein, the singular forms, "a", "an" and "the" are intended to include the plural forms as well, unless the context clearly indicates otherwise. The terms "includes" and/or "including", when used in this specification, specify the presence of stated features, integers, steps, operations, elements, and/or components, but do not preclude the presence or addition of one or more other features, integers, steps, operations, elements, components, and/or groups thereof. Unless otherwise defined, all terms (including technical and scientific terms) used herein have the meaning as commonly understood by one of ordinary skill in the art to which the present system and method belong.

Hereinafter, the present system and method are explained in detail with reference to the accompanying drawings.

FIG. 1 is a block diagram showing a display apparatus 1000 according to an exemplary embodiment of the present disclosure. Referring to FIG. 1, the display apparatus 1000 includes a display panel 100 to display an image, gate and data drivers 200 and 300 to drive the display panel 100, and a timing controller 400 to control the gate and data drivers 200 and 300.

The timing controller 400 receives image information RGB and control signals from an external image source (not shown). The control signals include a vertical synchronization signal Vsync as a frame distinction signal, a horizontal synchronization signal Hsync as a horizontal period distinction signal, a data enable signal DE that defines a period in which data are input, and a clock signal CLK. The data enable signal DE maintains a high level only during a period in which the data area output.

The timing controller 400 converts the data format of the image information RGB to a data format appropriate for interfacing between the data driver 300 and the timing controller 400. Particularly, the timing controller 400 generates an input image data Idata and applies the input image data Idata to the data driver 300. In addition, the timing controller 400 generates a data control signal DCS and a gate control signal GCS based on the control signals. The timing controller 400 applies the data control signal DCS to the data driver 300 and applies the gate control signal GCS to the gate driver 200.

The gate control signal GCS includes a scanning start signal to indicate the start of the scanning, the clock signal CLK to control the output period of a gate-on voltage, and an output enable signal to control the maintaining time of the gate-on voltage.

The data control signal DCS includes a horizontal start signal STH to indicate the start of transmission of the input image data Idata to the data driver 300, a load signal MS, an inverting signal POL, and the clock signal CLK.

The gate driver 200 sequentially applies gate signals to the display panel 100 in response to the gate control signal GCS provided from the timing controller 400.

The data driver 300 converts the input image data Idata to data voltages in response to the data control signal DCS provided from the timing controller 400. The data voltages are applied to the display panel 100.

The display panel 100 includes a plurality of gate lines GL1 to GLm, a plurality of data lines DL1 to DLn, and a plurality of pixels PX.

The gate lines GL1 to GLm extend in a first direction D1 and are arranged substantially in parallel to each other in a second direction D2 substantially perpendicular to the first direction D1. The gate lines GL1 to GLm are connected to and receive the gate signals from the gate driver 200.

The data lines DL1 to DLn extend in the second direction D2 and are arranged substantially in parallel to each other in the first direction D1. The data lines DL1 to DLn are connected to and receive the data voltages from the data driver 300.

Each pixel PX includes a switching device SW that outputs the data voltage in response to the gate signal and a liquid crystal capacitor Clc that becomes charged when the data voltage is applied. Each pixel PX is connected to a corresponding gate line of the gate lines GL1 to GLm and a corresponding data line of the data lines DL1 to DLn. In more detail, each pixel PX is turned on or off in response to the gate signal applied thereto through the corresponding gate line. When turned on, the pixel PX displays a gray scale corresponding to the data voltage received from the corresponding data line.

Various display panels may be used as the display panel 100, including a liquid crystal display panel, an organic light emitting display panel, an electrophoretic display panel, an electrowetting display panel, etc.

Figure 2:
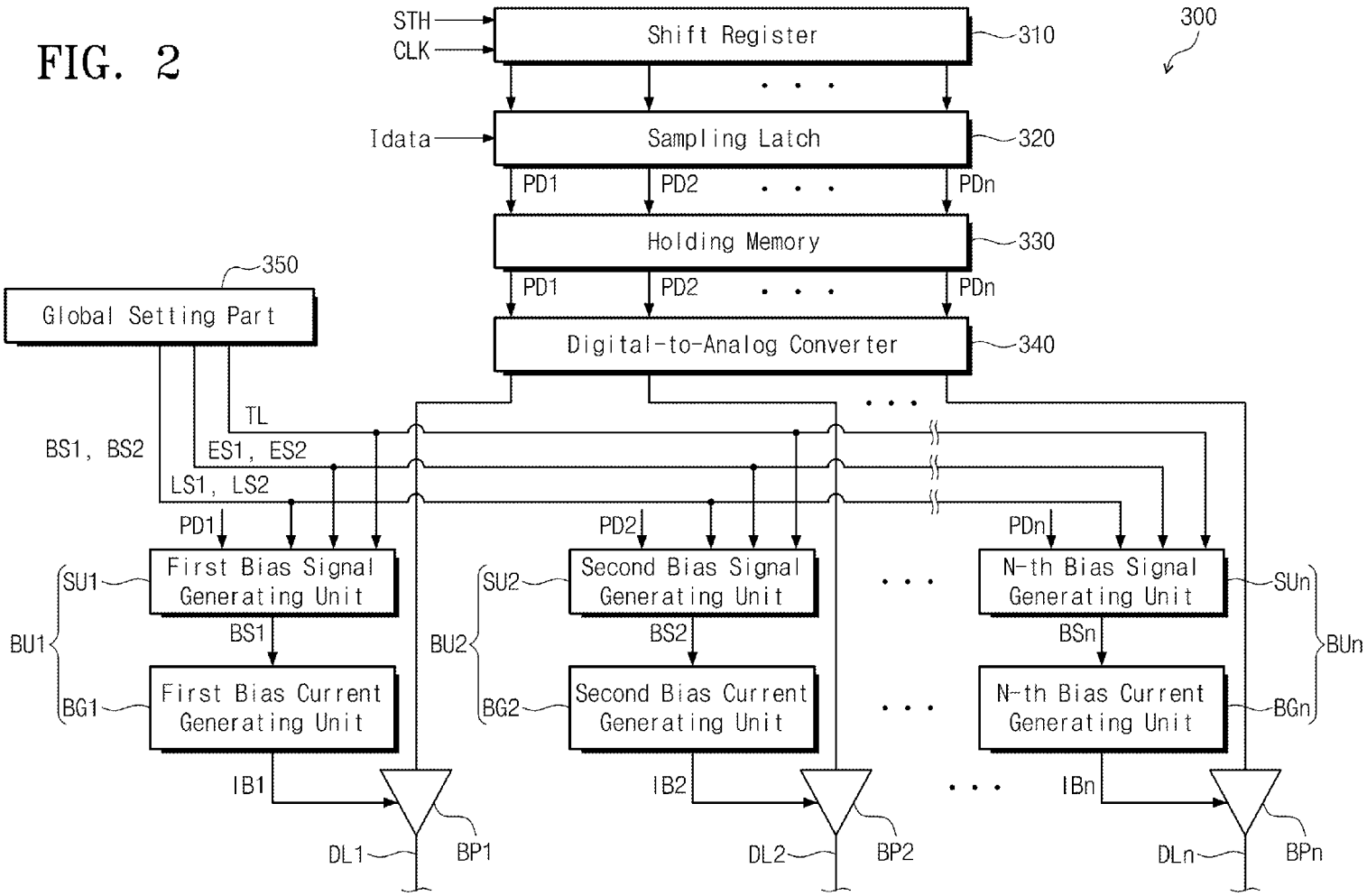
FIG. 2 is a block diagram showing a data driver shown in FIG. 1.

FIG. 2 is a block diagram showing the data driver 300 shown in FIG. 1. Referring to FIG. 2, the data driver 300 includes a shift register 310, a sampling latch 320, a holding memory 330, a digital-to-analog converter 340, and first to n-th buffers BP1 to BPn.

The shift register 310 includes a plurality of stages (not shown) connected to each other, one after another. Each stage is applied with the clock signal CLK. The first stage is applied with the horizontal start signal STH. When the first stage starts its operation in response to the horizontal start signal STH, the stages sequentially output a sampling signal in response to the clock signal CLK.

The sampling latch 320 receives the input image data Idata. In response to the sampling signal sequentially provided by each of the stages in the shift register 310, the sampling latch sequentially samples the input image data Idata, to generate first to n-th pixel image data PD1 to PDn corresponding to one line. That is, the first to n-th pixel image data PD1 to PDn correspond to images displayed in the pixels PX and correspond to one line addressed during one horizontal period. The sampling latch 320 outputs the first to n-th pixel image data PD1 to PDn to the holding memory 330 in response to a latch signal (not shown).

The holding memory 330 holds the first to n-th pixel image data PD1 to PDn provided from the sampling latch 320 and applies the first to n-th pixel image data PD1 to PDn to the digital-to-analog converter 340 during one horizontal period. The digital-to-analog converter 340 converts the first to n-th pixel image data PD1 to PDn to data voltages and applies the data voltages to the first to n-th buffers BP1 to BPn, respectively.

The first to n-th buffers BP1 to BPn receive the data voltages from the digital-to-analog converter 340 and output the data voltages to the data lines DL1 to DLn at the same time in response to the load signal MS.

The data driver 300 further includes a global setting part 350 and a plurality of bias units. As an example, the bias units include first to n-th bias units BU1 to BUn corresponding to the first to n-th buffers BP1 to BPn in a one-to-one correspondence.

The global setting part 350 generates a global setting signal. The setting signal includes a transition level value TL, a plurality of control level values, and a plurality of activation signals. As an example, the control level values include first and second level values LS1 and LS2, and the activation signals include first and second activation signals ES1 and ES2. The global setting part 350 outputs the first and second control level values LS1 and LS2, the first and second activation signals ES1 and ES2, and the transition level value TL to the first to n-th bias units BU1 to BUn.

The first to n-th bias units BU1 to BUn respectively generate first to n-th bias currents IB1 to IBn based on the first to n-th pixel image data PD1 to PDn and respectively apply the first to n-th bias currents IB1 to IBn to the first to n-th buffers BP1 to BPn. For instance, the first bias unit BU1 receives the first pixel image data PD1, generates the first bias current IB1 based on the first pixel image data PD1 and outputs the generated first bias current IB1 to the first buffer BP1 to bias the first buffer BP1.

The first to n-th bias units BU1 to BUn include first to n-th bias signal generating units SU1 to SUn and first to n-th bias current generating units BG1 to BGn. Each of the first to n-th bias signal generating units SU1 to SUn receives the first and second control levels LS1 and LS2, the first and second activation signals ES1 and ES2, and the transition level value TL from the global setting part 350.

In addition, the first to n-th bias signal generating units SU1 to SUn receive the first to n-th pixel image data PD1 to PDn, respectively. The first to n-th bias signal generating units SU1 to Sun, for example, may respectively receive the first to n-th pixel image data PD1 to PDn from the holding memory 330 or from the sampling latch 320.

The first to n-th bias signal generating units SU1 to SUn select one of the first and second control level values LS1 and LS2 and one of the first and second activation signals ES1 and ES2 in response to the first to n-th pixel image data PD1 to PDn and generate first to n-th bias signals BS1 to BSn based on the selected control level value and the selected activation signal. In more detail, the first to n-th bias signal generating units SU1 to SUn may generate the first to n-th bias signals BS1 to BSn in accordance to a variation in the data voltages output from the first to n-th buffers BP1 to BPn.

For instance, when a variation in the data voltage output from the first buffer BP1 is relatively large between a (L−1)th horizontal period and an L-th horizontal period following the (L−1)th horizontal period, the first bias signal generating unit SU1 selects one of the first and second control level values LS1 and LS2 to form the first bias current IB1 corresponding to the large variation in the data voltage and selects one of the first and second activation signals ES1 and ES2 to form the first bias current IB1 corresponding to the large variation in the data voltage. In this case, the first buffer BP1 is biased by the first bias current IB1 and has a relatively large throughput rate to output a large data variation.

On the contrary, when a variation in the data voltage output from the second buffer BP1 is relatively small, the second bias signal generating unit SU2 selects one of the first and second control level values LS1 and LS2 to form the second bias current IB2 corresponding to the small variation in the data voltage and selects one of the first and second activation signals ES1 and ES2 to form the second bias current IB2 corresponding to the small variation in the data voltage. In this case, the second buffer BP2 is biased by the second bias current IB2 and has a throughput rate that is smaller than the throughput rate of the first buffer BP1 but enough to output a small data variation. The operation of the first and second buffers BP1 and BP2 are described below with reference to FIG. 10.

The first to n-th bias current generating units BG1 to BGn respectively receive the first to n-th bias signals BS1 to BSn from the first to n-th bias signal generating units SU1 to SUn, generate the first to n-th bias currents IB1 to IBn in response to the first to n-th bias signals BS1 to BSn, and apply the first to n-th bias currents IB1 to IBn to the first to n-th buffers BP1 to BPn. The first to n-th bias units BU1 to BUn are described below with reference to FIG. 8.

Figure 3:
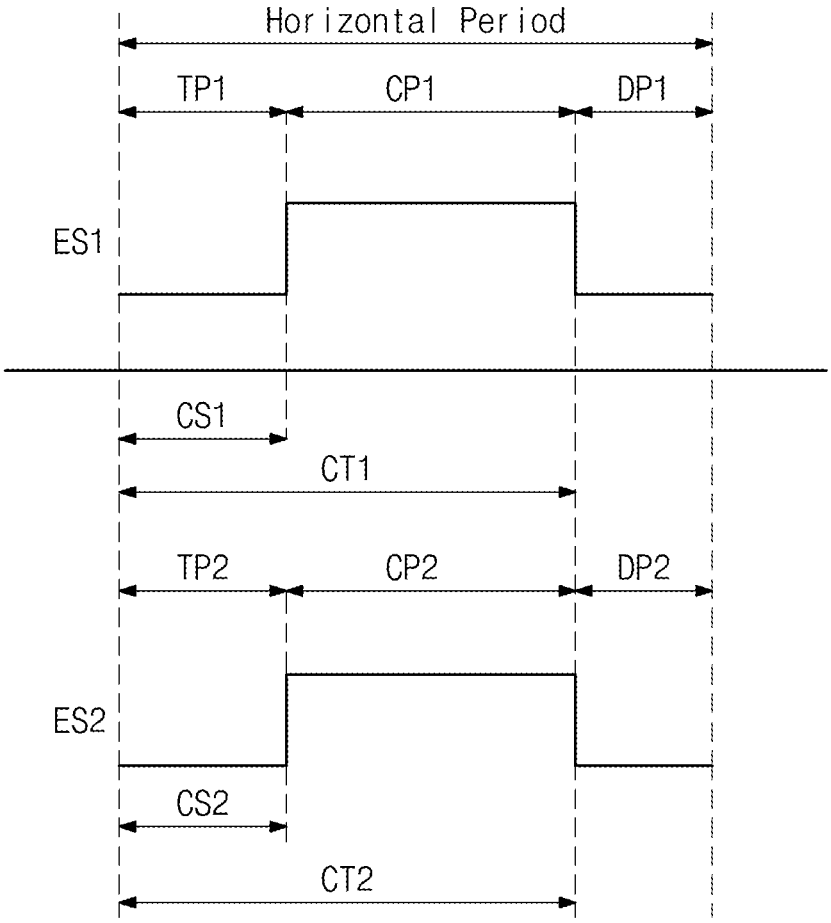
FIG. 3 is a waveform diagram showing first and second activation signals shown in FIG. 2.
Figure 4:
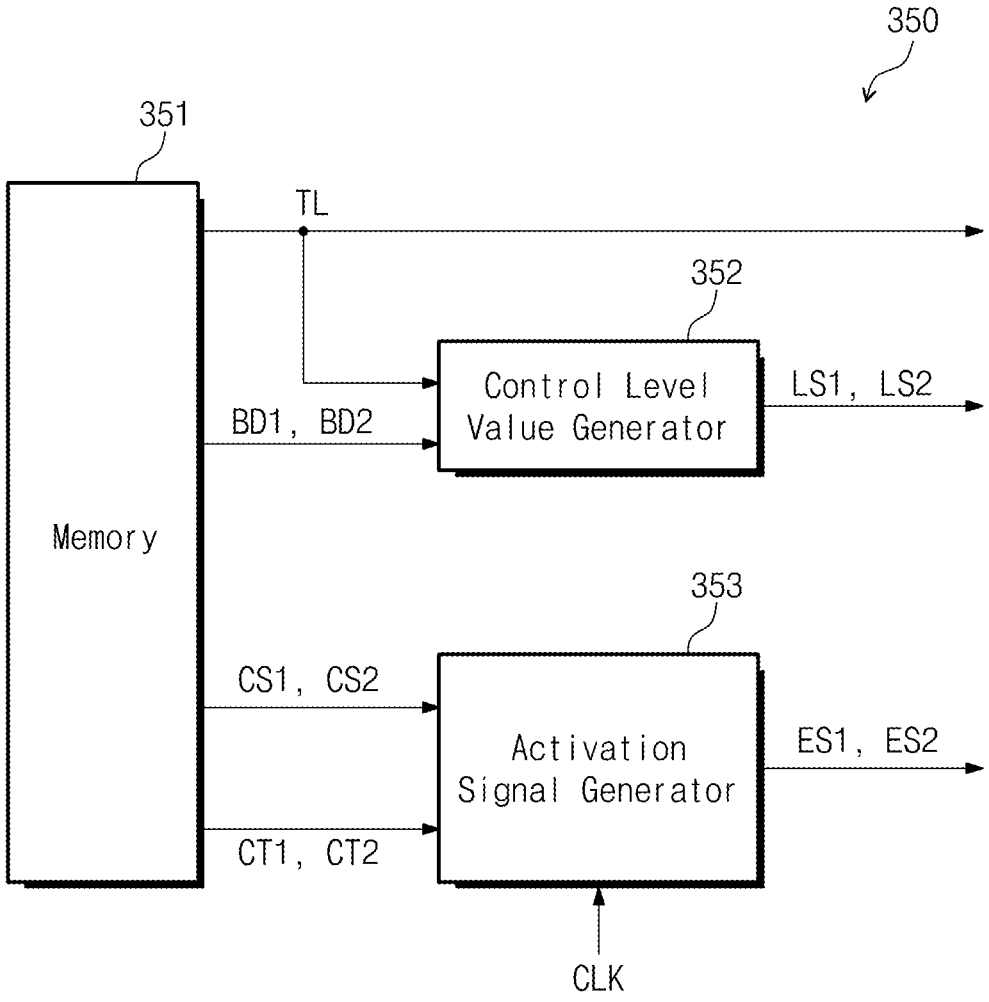
FIG. 4 is block diagram showing a global setting part shown in FIG. 2.

FIG. 3 is a waveform diagram showing the first and second activation signals ES1 and ES2 shown in FIG. 2. FIG. 4 is block diagram showing the global setting part 350 shown in FIG. 2.

Referring to FIG. 3, the first activation signal ES1 includes a first transition period TP1, a first control period CP1, and a first dummy period DP1, which are defined in each horizontal period. As an example, the first transition period TP1 is defined between a start point of each horizontal period and a start point of the first control period CP1. The first dummy period DP1 is defined between an end point of the first control period CP1 and an end point of each horizontal period. The first activation signal ES1 has a high level in the first control period CP1 and has a low level in the first transition period TP1 and the first dummy period DP1.

In the exemplary embodiment of FIG. 3, the first transition period TP1, the first control period CP1, and the first dummy period DP1 are arranged in order as listed in each horizontal period. The first transition period TP1, the first control period CP2, and the first dummy period DP1 do not overlap with each other.

The second activation signal ES2 includes a second transition period TP2, a second control period CP2, and a second dummy period DP2, which are defined in each horizontal period. As an example, the second transition period TP2 is defined between a start point of each horizontal period and a start point of the second control period CP2. The second dummy period DP2 is defined between an end point of the second control period CP2 and an end point of each horizontal period. The second activation signal ES2 has the high level in the second control period CP2 and has the low level in the second transition period TP2 and the second dummy period DP2.

In the exemplary embodiment of FIG. 3, the second transition period TP1, the second control period CP2, and the second dummy period DP2 are arranged in order as listed in each horizontal period. The second transition period TP2, the second control period CP2, and the second dummy period DP2 do not overlap with each other.

In the exemplary embodiment of FIG. 3, the first and second activation signals ES1 and ES2 are substantially same as each other, but the present system and method are not limited thereto. That is, the first and second activation signals ES1 and ES2 may have different waveforms from each other.

Referring to FIG. 4, the global setting part 350 includes a memory 351, a control level value generator 352, and an activation signal generator 353. The memory 351 stores a transition level value TL, first and second bias difference values BD1 and BD2, first and second control start time points CS1 and CS2, and first and second control end time points CT1 and CT2.

The first and second bias difference values BD1 and BD2 may include information about differences between the transition level value TL and the first and second transition level values TL1 and TL2. The first and second control start time points CS1 and CS2 may include information about the start point of the first and second control periods CP1 and CP2. The first and second control end time points CT1 and CT2 may including information about the end point of the first and second control periods CP1 and CP2.

The control level value generator 352 receives the transition level value TL and the first and second bias difference values BD1 and BD2 from the memory 351. The control level value generator 352 subtracts the first and second bias difference values BD1 and BD2 from the transition level value TL and generates first and second control level values LS1 and LS2.

The activation signal generator 353 receives the clock signal CLK and generates the first activation signal ES1 based on the first control start time point CS1 and the first end time point CT1. In more detail, the activation signal generator 353 counts a first time lapse from the start point of each horizontal period to the first control start time point CS1 using the clock signal CLK and outputs a low level during the first time lapse.

Then, the activation signal generator 353 counts a second time lapse from the start point of each horizontal period to the first control end time point CT1 using the clock signal CLK and outputs a high level during the second time lapse.

After that, the activation signal generator 353 generates the low level during the period from the first control end time point CT1 to the end point of the horizontal period. As a result, the activation signal generator 353 outputs the first activation signal ES1 that has the low level during the first transition period TP1 and the first dummy period DP1 and has the high level during the first control period CP1.

The activation signal generator 353 generates the second activation signal ES2 based on the second control start time point CS2 and the second control end time point CT2 in the same way as that used to generate the first activation signal ES1.

Figure 5:
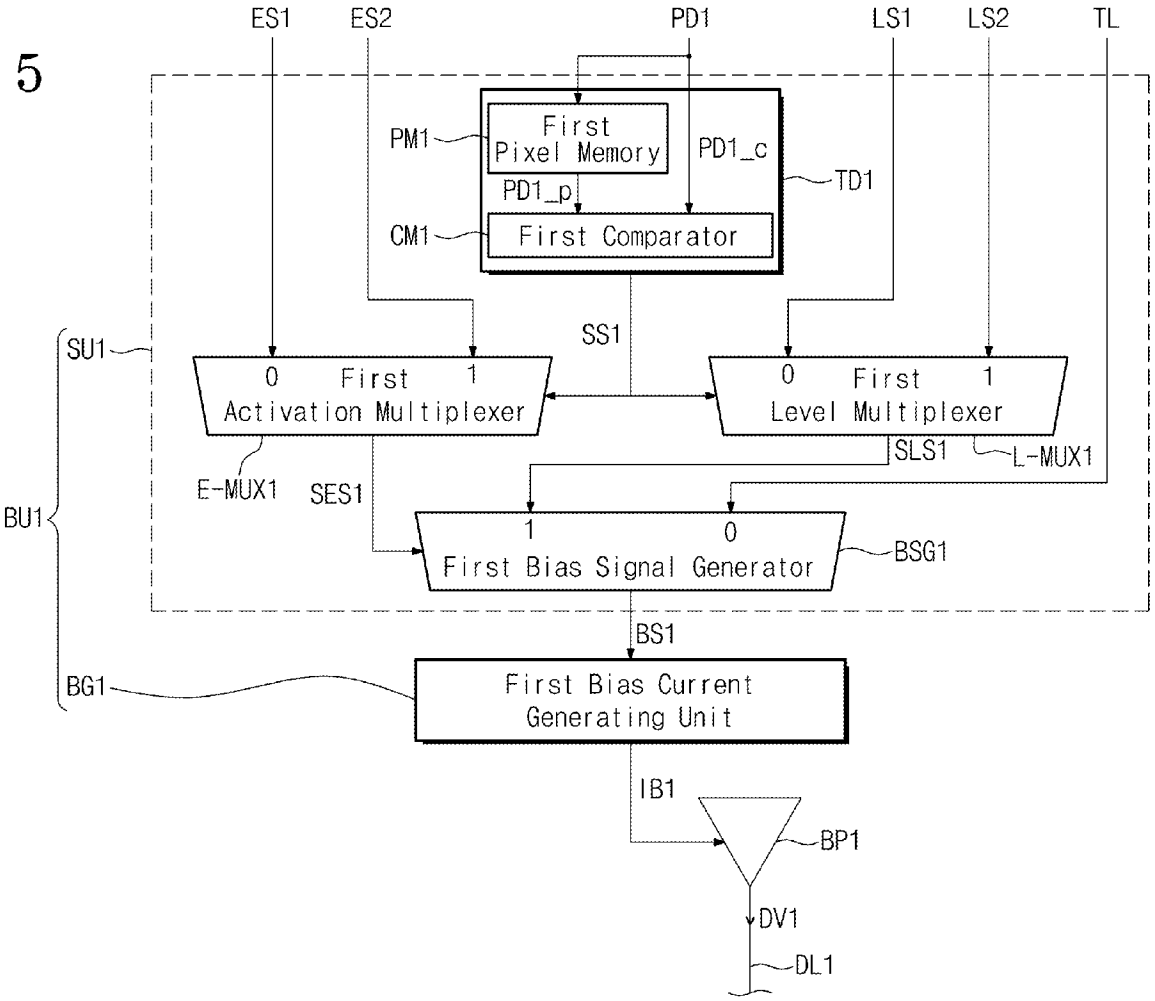
FIG. 5 is a block diagram showing a first bias unit shown in FIG. 2.
Figure 6:
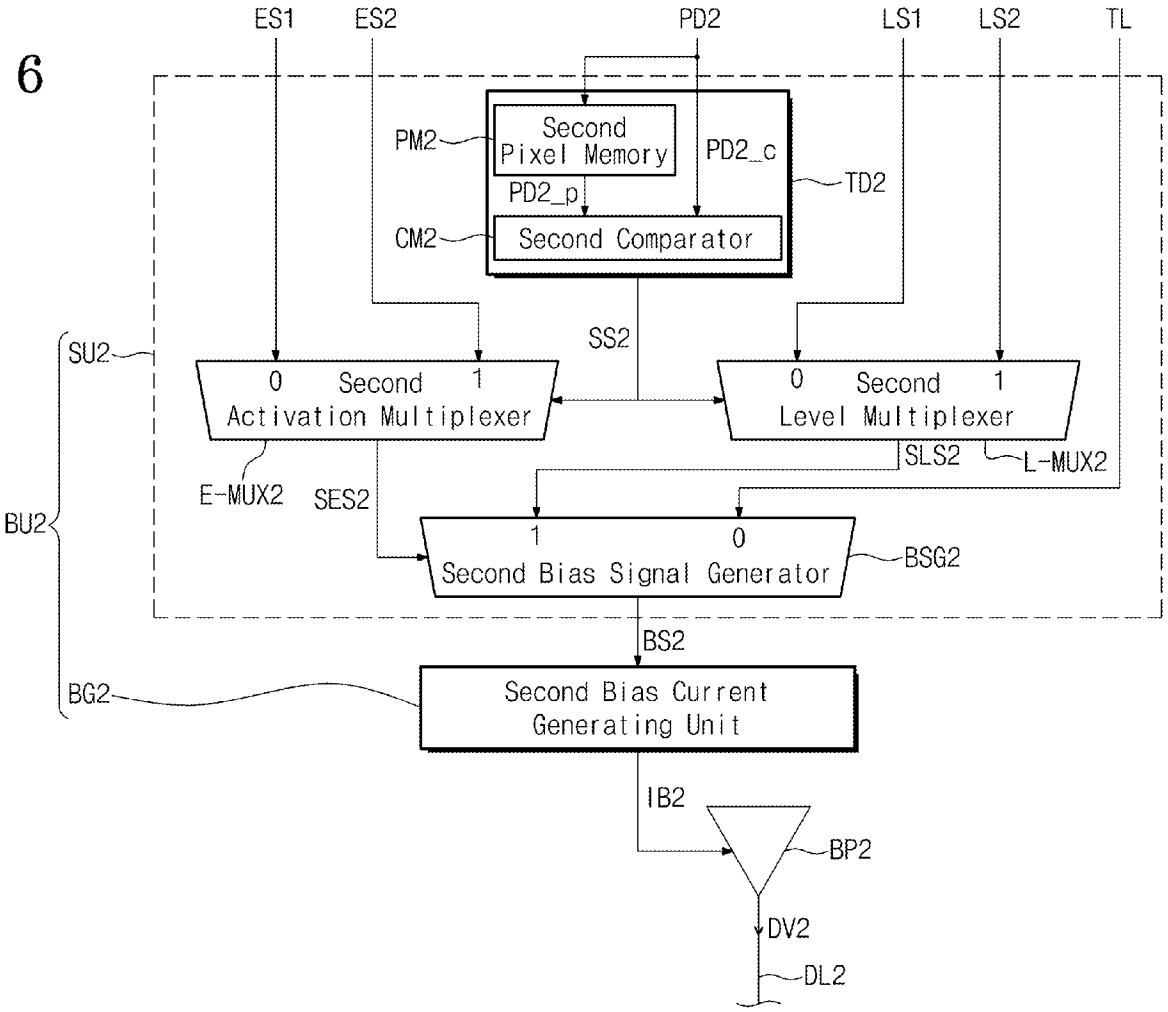
FIG. 6 is a block diagram showing a second bias unit shown in FIG. 2.

FIG. 5 is a block diagram showing a first bias unit shown in FIG. 2. FIG. 6 is a block diagram showing a second bias unit shown in FIG. 2.

Referring to FIG. 5, the first bias unit BU1 includes the first bias signal generating unit SU1 and the first bias current generating unit BG1. The first bias signal generating unit SU1 includes a first variation detector TD1, a first activation multiplexer E-MUX1, a first level multiplexer L-MUX1, and a first bias signal generator BSG1.

The first variation detector TD1 receives the first pixel image data PD1 and generates a first selection signal SS1 in response to the first pixel image data PD1. The first variation detector TD1 includes a first pixel memory PM1 and a first comparator CM1.

The first comparator CM1 receives a previous first pixel image data PD1_p provided in the (L−1)th horizontal period and a present first pixel image data PD1_c provided in the L-th horizontal period. The L-th horizontal period follows the (L−1)th horizontal period.

The first pixel memory PM1 stores the previous first pixel image data PD1_p from the (L−1)th horizontal period and applies the previous first pixel image data PD1_p to the first comparator CM1 during the L-th horizontal period. That is, the first pixel memory PM1 receives the previous first pixel image data PD1_p during the (L−1)th horizontal period in which the previous first pixel image data PD1_p is provided. Then, the first pixel memory PM1 applies the previous first pixel image data PD1_p to the first comparator CM1 during the L-th horizontal period.

The first comparator CM1 compares the previous first pixel image data PD1_p and the present first pixel image data PD1_c to generate the first selection signal SS1. As an example, the first comparator CM1 calculates an absolute value of a difference between a previous grayscale value of the previous first pixel image data PD1_p and a present grayscale value of the present first pixel image data PD1_c and generates the first selection signal SS1 based on the absolute value of the difference between the previous grayscale value and the present grayscale value.

As an example, the first comparator CM1 compares an upper 1 bit of the present first pixel image data PD1_c with an upper 1 bit of the previous first pixel image data PD1_p to calculate the difference between the previous grayscale value of the previous first pixel image data PD1_p and the present grayscale value of the present first pixel image data PD1_c. In this case, the first comparator CM1 performs an exclusive-OR calculation on the upper 1 bit of the present first pixel image data PD1_c and the upper 1 bit of the previous first pixel image data PD1_p to output the first selection signal SS1.

To illustrate, consider the case in which the difference between the previous grayscale value and the present grayscale value is large and the case in which the difference is small. For example, when the previous grayscale value corresponds to 10 grayscale level among 256 grayscale levels and the present gray scale value corresponds to 255 grayscale level among 256 grayscale levels, meaning the difference is large, the upper 1 bit of the previous first pixel image data PD1_p has a value of "0" and the upper 1 bit of the present first pixel image data PD1_c has a value of "1". Accordingly, the first selection signal SS1 has the value of "1" when the exclusive-OR calculation is performed.

On the contrary, when the previous grayscale value corresponds to 250 grayscale level among 256 grayscale levels and the present gray scale value corresponds to 255 grayscale level among 256 grayscale levels, meaning the difference is small, the upper 1 bit of the previous first pixel image data PD1_p has the value of "1" and the upper 1 bit of the present first pixel image data PD1_c has the value of "0". Therefore, the first selection signal SS1 has the value of "0" when the exclusive-OR calculation is performed.

The first level multiplexer L-MUX1 receives the first and second control level values LS1 and LS2 from the global setting part 350 and the first selection signal SS1 from the first comparator CM1. The first level multiplexer L-MUX1 selects one of the first and second control level values LS1 and LS2 in response to the first selection signal SS1 and outputs the selected control level value of the first and second control level values LS1 and LS2 as a first selection control level value SLS1. For instance, when the first selection signal SS1 has the value of "0", the first level multiplexer L-MUX1 selects the first control level value LS1, and when the first selection signal SS1 has the value of "1", the first level multiplexer L-MUX1 selects the second control level value LS2.

The first activation multiplexer E-MUX1 receives the first and second activation signals ES1 and ES2 from the global setting part 350 and the first selection signal SS1 from the first comparator CM1. The first activation multiplexer E-MUX1 selects one of the first and second activation signals ES1 and ES2 in response to the first selection signal SS1 and outputs the selected activation signal of the first and second activation signals ES1 and ES2 as a first selection activation signal SES1. For instance, when the first selection signal SS1 has the value of "0", the first activation multiplexer E-MUX1 selects the first activation signal ES1, and when the first selection signal SS1 has the value of "1", the first activation multiplexer E-MUX1 selects the second activation signal ES2.

The first bias signal generator BSG1 receives the transition level value TL, the first selection control level value SLS1, and the first selection activation signal SES1. The first bias signal generator BSG1 selects one of the transition level value TL and the first selection control level value SLS1 in response to the first selection activation signal SES1 to generate the first bias signal BS1.

Figure 7:
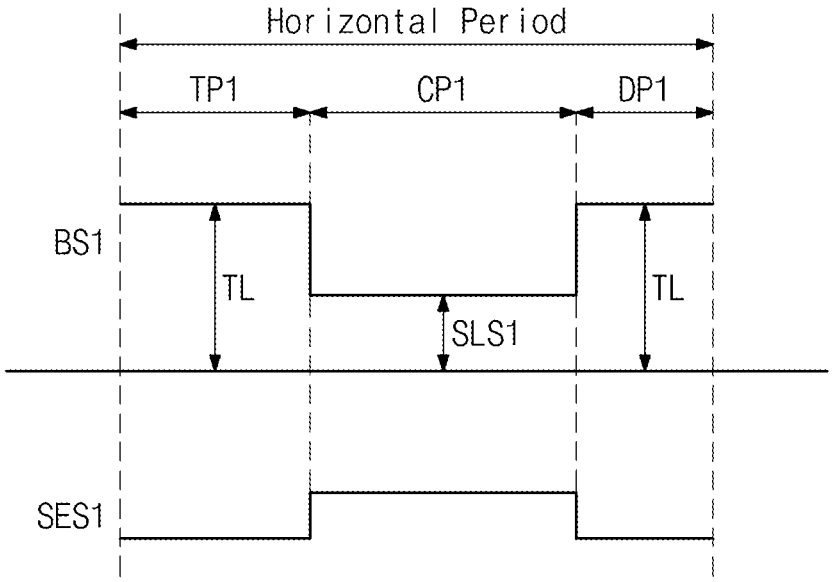
FIG. 7 is a waveform diagram showing a first bias signal shown in FIG. 5.

FIG. 7 is a waveform diagram showing the first bias signal BS1 shown in FIG. 5. Hereinafter, the operation of the first bias signal generator BSG1, which generates the first bias signal BS1, are described with reference to FIG. 7. The first bias signal generator BSG1 selects and outputs the transition level value TL as the first bias signal BS1 when the first selection activation signal SES1 has the low level. The first bias signal generator BSG1 selects and outputs the first selection control level value SLS1 as the first bias signal BS1 when the first selection activation signal SES1 has the high level. As a result, the first bias signal BS1 has the transition level value TL during the first transition period TP1 and the first dummy period DP1 and has the first selection control level value SLS1 during the first control period CP1.

Referring to FIG. 5 again, the first bias current generating unit BG1 receives the first bias signal BS1 from the first bias signal generator BSG1 and generates the first bias current IB1 in response to the first bias signal BS1. The first bias current generating unit BG1 outputs the first bias current IB1 to the first buffer BP1 to bias the first buffer BP1.

Figure 8:
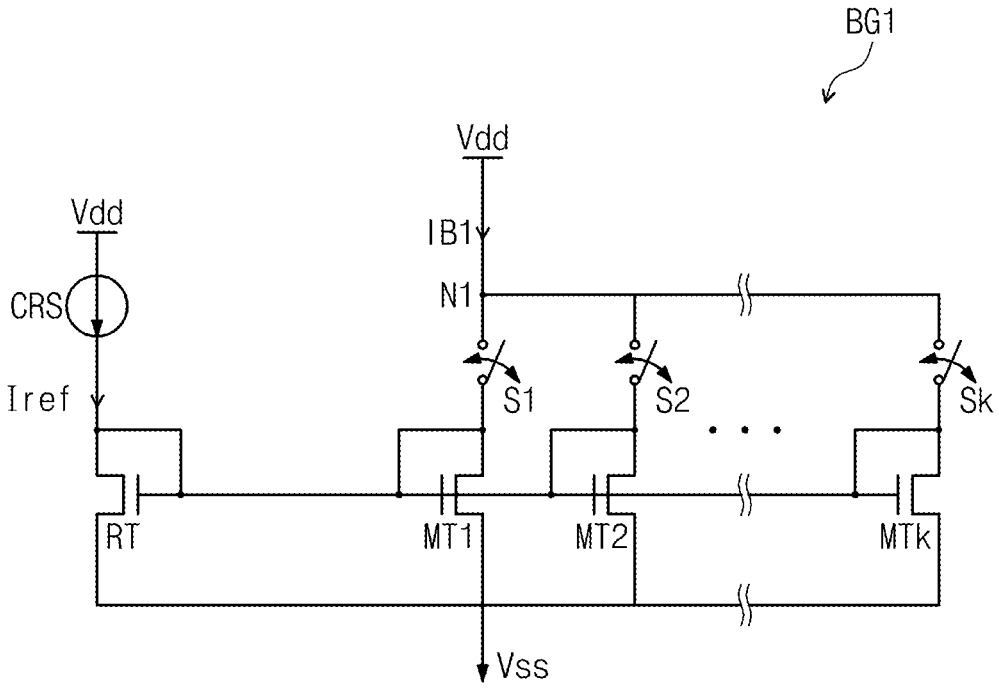
FIG. 8 is a block diagram showing a first bias current generating unit shown in FIG. 5.

FIG. 8 is a block diagram showing the first bias current generating unit BG1 shown in FIG. 5. Referring to FIG. 8, the first bias current generating unit BG1 includes a current source CRS, a reference transistor RT, first to k-th mirror transistors MT1 to MTk, and first to k-th switches S1 to Sk.

One terminal of the current source CRS is connected to a first voltage source Vdd and the other terminal of the current source CRS is connected to the reference transistor RT. The current source CRS applies a reference bias current Iref to the reference transistor RT. Although not shown, a resistor may be used as the current source CRS. In more detail, the resistor may be connected between the first voltage source Vdd and the reference transistor RT such that the reference bias current Iref is determined by the resistance of the resistor.

The source and drain of the reference transistor RT are respectively connected to the current source CRS and a second voltage source Vss. The gate of the reference transistor RT is connected to the source of the reference transistor RT.

The gate of each of the first to k-th mirror transistors MT1 to MTk is connected to the gate of the reference transistor RT. In addition, the gate and the source of each of the first to k-th mirror transistors MT1 to MTk are connected to each other. The drain of each of the first to k-th mirror transistors MT1 to MTk is connected to the second source voltage Vss. The source of each of the first to k-th mirror transistors MT1 to MTk is connected to one end of a corresponding one of the first to k-th switches S1 to Sk.

The other end of each of the first to k-th switches S1 to Sk is connected to the first voltage source Vdd. Nodes at which the other ends of the first to k-th switches S1 to Sk are connected to the first voltage source Vdd are referred to as first nodes N1.

When the reference bias current Iref is applied to the reference transistor RT, the first to k-th mirror transistors MT1 to MTk respectively generate first to k-th mirror currents by a current mirroring operation. In this case, the first to k-th mirror currents flow from the first nodes N1 through the source and the drain of the first to k-th mirror transistors MT1 to MTk when the first to k-th switches S1 to Sk are switched on. For instance, the first mirror current flows from the first node N1 through the source and the drain of the first mirror transistor MT1 when the first switch S1 is switched on. The first to k-th mirror transistors MT1 to MTk may have different sizes, in which case, the first to k-th mirror currents may have different values.

When the first to k-th switches S1 to Sk are turned on or off in response to the level of the first bias signal BS1, the first bias current IB1 flowing through the first node N1 is varied. The magnitude of the first bias current IB1 corresponds to the sum of the mirror currents flowing through the switches turned on by the first bias signal BS1.

As the first to k-th switches can be turned on and off in various combinations according to the first bias signal BS1, the magnitude of the first bias current IB1 can be controlled. In other words, the turning on or off of each of the first to k-th switches may be determined such that the magnitude of the first bias current IB1 corresponds to the level of the first bias signal BS1.

Referring to FIG. 6, the second bias unit BU2 includes the second bias signal generating unit SU2 and the second bias current generating unit BG2. The second bias signal generating unit SU2 includes a second variation detector TD2, a second activation multiplexer E-MUX2, a second level multiplexer L-MUX2, and a second bias signal generator BSG2.

The second variation detector TD2 receives the second pixel image data PD2 and generates a second selection signal SS2 in response to the second pixel image data PD2. The second variation detector TD2 includes a second pixel memory PM2 and a second comparator CM2.

The second comparator CM2 receives includes a previous second pixel image data PD2_*p* provided in the (L−1)th horizontal period and a present second pixel image data PD2_*c* provided in the L-th horizontal period.

The second pixel memory PM2 stores the previous second pixel image data PD2_*p* from the (L−1)th horizontal period and applies the previous second pixel image data PD2_p to the second comparator CM2 during the L-th horizontal period. That is, the second pixel memory PM2 receives the previous second pixel image data PD2_p during the (L−1)th horizontal period in which the previous second pixel image data PD2_p is provided. Then, the second pixel memory PM2 applies the previous second pixel image data PD2_p to the second comparator CM2 during the L-th horizontal period.

The second comparator CM2 compares the previous second pixel image data PD2_p and the present second pixel image data PD2_c to generate the second selection signal SS2. As an example, the second comparator CM2 calculates an absolute value of a difference between a previous grayscale value of the previous second pixel image data PD2_p and a present grayscale value of the present second pixel image data PD2_c and generates the second selection signal SS2 based on the absolute value of the difference between the previous grayscale value and the present grayscale value. The operation of the second comparator CM2 is substantially the same as that of the first comparator CM1 except that the second comparator CM2 receives the previous second pixel image data PD2_p and the present second pixel image data PD2_c, and thus details on the operation of the second comparator CM2 are omitted.

The second level multiplexer L-MUX2 receives the first and second control level values LS1 and LS2 from the global setting part 350 and the second selection signal SS2 from the second comparator CM2. The second level multiplexer L-MUX2 selects one of the first and second control level values LS1 and LS2 in response to the second selection signal SS2 and outputs the selected control level value of the first and second control level values LS1 and LS2 as a second selection control level value SLS2. For instance, when the second selection signal SS2 has the value of "0", the second level multiplexer L-MUX2 selects the first control level value LS1, and when the second selection signal SS2 has the value of "1", the second level multiplexer L-MUX2 selects the second control level value LS2.

The second activation multiplexer E-MUX2 receives the first and second activation signals ES1 and ES2 from the global setting part 350 and the second selection signal SS2 from the second comparator CM2. The second activation multiplexer E-MUX2 selects one of the first and second activation signals ES1 and ES2 in response to the second selection signal SS2 and outputs the selected activation signal of the first and second activation signals ES1 and ES2 as a second selection activation signal SES2. For instance, when the second selection signal SS2 has the value of "0", the second activation multiplexer E-MUX2 selects the first activation signal ES1, and when the second selection signal SS2 has the value of "1", the second activation multiplexer E-MUX2 selects the second activation signal ES2.

The second bias signal generator BSG2 receives the transition level value TL, the second selection control level value SLS2, and the second selection activation signal SES2. The second bias signal generator BSG2 selects one of the transition level value TL and the second selection control level value SLS2 in response to the second selection activation signal SES2 to generate the second bias signal BS2.

Figure 9:
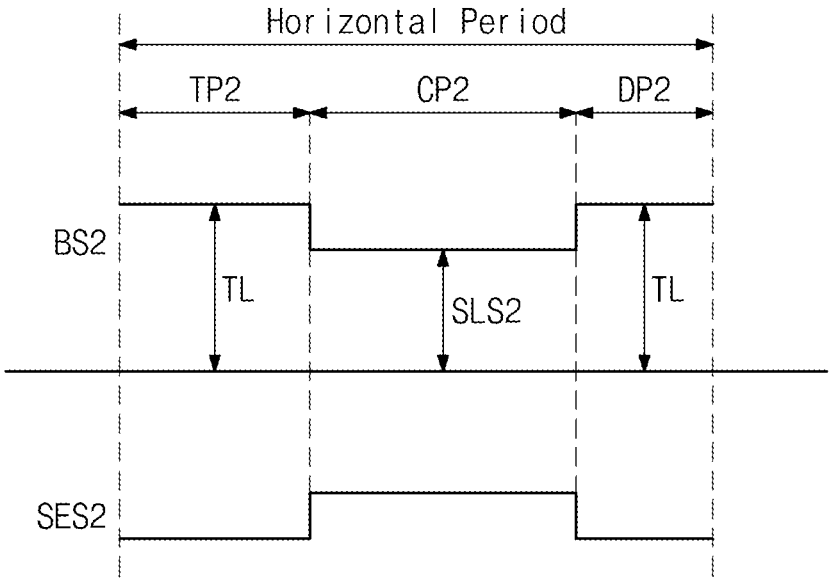
FIG. 9 is a waveform diagram showing a second bias signal shown in FIG. 6.

FIG. 9 is a waveform diagram showing the second bias signal BS2 shown in FIG. 6. Hereinafter, the operation of the second bias signal generator BSG2, which generates the second bias signal BS1, is described with reference to FIG. 9. The second bias signal generator BSG2 selects and outputs the transition level value TL as the second bias signal BS2 when the second selection activation signal SES2 has the low level. The second bias signal generator BSG2 selects and outputs the second selection control level value SLS2 as the second bias signal BS2 when the second selection activation signal SES2 has the high level. As a result, the second bias signal BS2 has the transition level value TL during the second transition period TP2 and the second dummy period DP2 and has the second selection control level value SLS2 during the second control period CP2.

The second bias current generating unit BG2 receives the second bias signal BS2 from the second bias signal generator BSG2 and generates the second bias current IB2 in response to the second bias signal BS2. The second bias current generating unit BG2 outputs the second bias current IB2 to the second buffer BP2. The second bias current generating unit BG2 has a similar structure and function as those of the first bias current generating unit BG1, and thus details on the second bias current generating unit BG2 are omitted.

Figure 10:
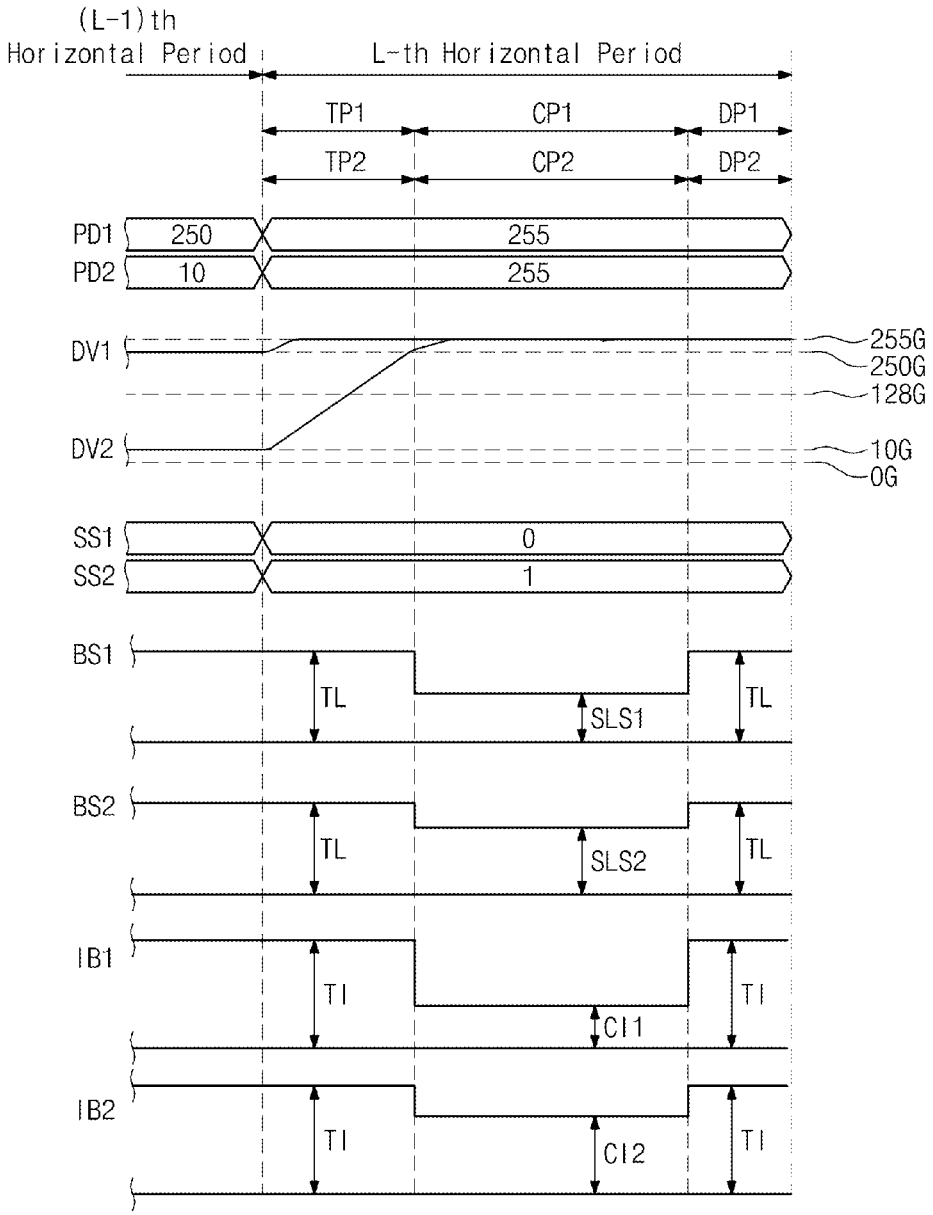
FIG. 10 is a timing diagram of signals shown in FIGS. 5 and 6.

FIG. 10 is a timing diagram of the signals shown in FIGS. 5 and 6. Hereinafter, the operation of the data driver is described with reference to FIGS. 5, 6, and 10. In the exemplary embodiment of FIG. 10, the previous grayscale value of the previous first pixel image data PD1_p corresponds to 250 grayscale level among 256 grayscale levels, and the present grayscale value of the present first pixel image data PD1_c corresponds to 255 grayscale level among 256 grayscale levels.

The first buffer BP1 outputs a first data voltage DV1 corresponding to the first pixel image data PD1. In more detail, the first data voltage DV1 has a first voltage 250G corresponding to the 250 grayscale level during the (L−1)th horizontal period and has a second voltage 255G corresponding to the 255 grayscale level during the first control period CP1 of the L-th horizontal period according to the present grayscale value of the first pixel image data PD1_c. In other words, a variation (or difference) of the first data voltage DV1 is small during the horizontal period.

Meanwhile, the previous grayscale value of the previous second pixel image data PD2_p corresponds to the 10 grayscale level among 256 grayscale levels, and the present grayscale value of the present second pixel image data PD2_c corresponds to the 255 grayscale level among 256 grayscale levels.

The second buffer BP2 output a second data voltage DV2 corresponding to the second pixel image data PD1. The second data voltage DV2 has a third voltage 10G corresponding to the previous grayscale level of the previous second pixel image data PD2_p during the (L−1)th horizontal period and has the second voltage 255G during the L-th horizontal period according to the present grayscale level of the present second pixel image PD2_c. In other words, a variation (or difference) of the second data voltage DV2 is large during the horizontal period.

As described with reference to FIG. 3, the first and second control level values LS1 and LS2 have substantially the different values. In addition, the first transition period TP1, the first control period CP1, and the first dummy period DP1 are substantially the same as the second transition period TP2, the second control period CP2, and the second dummy period DP2, respectively.

The first variation detector TD1 compares the previous grayscale value of the previous first pixel image data PD1_p and the present grayscale value of the present first pixel image data PD1_c during the L-th horizontal period and generates the first selection signal SS1 having the value of "0".

The first activation multiplexer E-MUX1 selects and outputs the first activation signal ES1 as the first selection activation signal SES1 in response to the first selection signal SS1. The first level multiplexer L-MUX1 selects and outputs the first control level value LS1 as the first selection control level value SLS1 in response to the first selection signal SS1. Then, the first bias signal generator BSG1 outputs the transition level value TL when the first selection activation signal SES1 has the low level and selects the first selection control level value SLS1 when the first selection activation signal SES1 has the high level to generate the first bias signal BS1. Accordingly, the first bias signal BS1 has the transition level value TL during the first transition period TP1 and the first dummy period DP1 and has the first selection control level value SLS1 during the first control period CP1.

The second variation detector TD2 compares the previous grayscale value of the previous second pixel image data PD2_*p* and the present grayscale value of the present second pixel image data PD2_*c* and generates the second selection signal SS2 having the value of "1".

The second activation multiplexer E-MUX2 selects and outputs the second activation signal ES2 as the second selection activation signal SES2 in response to the second selection signal SS2. The second level multiplexer L-MUX2 selects and outputs the second control level value LS2 as the second selection control level value SLS2 in response to the second selection signal SS2. Then, the second bias signal generator BSG2 outputs the transition level value TL when the second selection activation signal SES2 has the low level, and selects the second selection control level value SLS2 when the second selection activation signal SES2 has the high level to generate the second bias signal BS2. Therefore, the second bias signal BS2 has the transition level value TL during the second transition period TP2 and the second dummy period DP2 and has the second selection control level value SLS2 during the second control period CP2.

The first bias current generating unit BG1 generates the first bias current IB1 based on the first bias signal BS1, and the second bias current generating unit BG2 generates the second bias current IB2 based on the second bias signal BS2.

Accordingly, the first and second bias currents IB1 and IB2 have a transition current TI corresponding to the transition level value TL during the first and second transition periods TP1 and TP2 and the first and second dummy periods DP1 and DP2.

The first bias current IB1 has a first control current CI1 corresponding to the first selection control level value SLS1 during the first control period CP1, and the second bias current IB2 has a second control current CI2 corresponding to the second selection control level value SLS2 during the second control period CP2.

The first and second buffers BP1 and BP2 are biased by the bias currents IB1 and IB2, respectively. The throughput rate of each of the first and second buffers BP1 and BP2 increases with an increase in the respective bias current. The power consumption of each of the first and second buffers BP1 and BP2 also increases with an increase in the respective bias current.

Thus, since the first control current CI1 is smaller than the second control current CI2, the power consumption of the first and second buffers BP1 and BP2 when assuming the first and second buffers BP1 and BP2 are biased by a control current having a magnitude corresponding to the first control current CI1 is smaller than a power consumption in the first and second buffers BP1 and BP2 when assuming the first and second buffers BP1 and BP2 are biased by a control current having a magnitude corresponding to the second control current CI2.

In addition, since the first control current CI1 is smaller than the second control current CI2, the through rate of the first and second buffers BP1 and BP2 when assuming the first and second buffers BP1 and BP2 are biased by a control current having a magnitude corresponding to the first control current CI1 is smaller than the through rate of the first and second buffers BP1 and BP2 when assuming the first and second buffers BP1 and BP2 are biased by a control current having a magnitude corresponding to the second control current CI2.

The first bias current IB1 is applied to the first buffer BP1 that outputs the first data voltage DV1, which is slightly varied according to the horizontal period. The second bias current IB2 is applied to the second buffer BP2 that outputs the second data voltage DV2, which is greatly varied according to the horizontal period.

In this case, since the second buffer BP2 is biased by the second control current CI2 greater than the first control current CI1 during the second control period CP2, the second buffer BP2 has sufficient throughput rate to output the second data voltage DV2 even though it is greatly varied. In more detail, since the variation amount of the second data voltage DV2 is large, the second data voltage DV2 does not increase to the second voltage 255G at the start point of the second control period CP2. However, because the second control current CI2 is applied to the second buffer BP2 during the second control period CP2, the second data voltage DV2 rapidly increases to the second voltage 255G.

Meanwhile, since the variation in amount of the first data voltage DV1 is relatively small, the first data voltage DV1 reaches the second voltage 255G at the start point of the first control period CP1, and the large bias current does not need to be applied to the first buffer BP1 in the first control period CP1. The first buffer BP1 is biased by the first control current CI1 smaller than the second control current CI2 during the first control period CP1, and thus the power consumption of the first buffer BP1 is more reduced than the power consumption of the second buffer BP2.

As described above, the first and second bias units BU1 and BU2 respectively generate the first and second bias signals BS1 and BS2 in accordance with the first and second pixel image data PD1 and PD2 and respectively apply the first and second bias signals BS1 and BS2 to the first and second buffers BP1 and BP2.

Therefore, the first and second buffers BP1 and BP2 are respectively applied with the first and second bias currents IB1 and IB2 that respectively correspond to the variations in amount of the first and second data voltages DV1 and DV2 and have throughput rates that respectively correspond to the variations in amount of the first and second data voltages DV1 and DV2. As a result, the power consumption of the first and second buffers BP1 and BP2 may be reduced.

In addition, the layout of the data driver 300 may be simplified since the data driver 300 includes only one global setting part 350 having a complex circuit configuration, and the first to n-th buffers BP1 to BPn respectively include the first and n-th bias units BU1 to Bun, each having a simple circuit configuration to select the signal and values corresponding to the pixel data among the signal and values generated by the global setting part 350.

The first and second bias units BU1 and BU2 are described above as a representative example. Detailed descriptions of the third to n-th bias units BU3 to BUn are omitted since the first to n-th bias units BU1 to BUn have the same structure and function.

Figure 11:
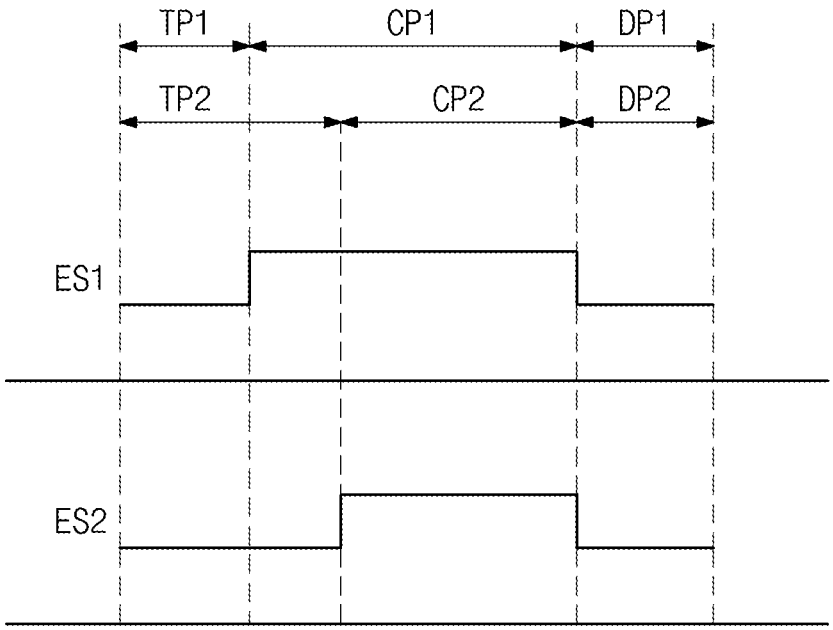
FIG. 11 is a waveform diagram of first and second activation signals shown in FIG. 2 according to another exemplary embodiment of the present disclosure.

FIG. 11 is a timing diagram of the first and second activation signals shown in FIG. 2 according to another exemplary embodiment of the present disclosure. Referring to FIG. 11, the first and second control periods CP1 and CP2 are different from each other. That is, at least a portion of the first control period CP1 does not overlap with the second control period CP2. As an example, the duration of the first control period CP1 is greater than that of the second control period CP2, and the end point of the first control period CP1 is substantially the same as the end point of the second control period CP2. Thus, the start point of the first control period CP1 occurs earlier than the start point of the second control period CP2.

According to another exemplary embodiment, at least a portion of the second control period CP2 does not overlap with the first control period CP1. In addition, according to another exemplary embodiment, the first and second control periods CP1 and CP2 may have the same duration but different start points.

In an exemplary embodiment, the first control level value LS1 may be substantially the same as the transition level value TL.

Figure 12:
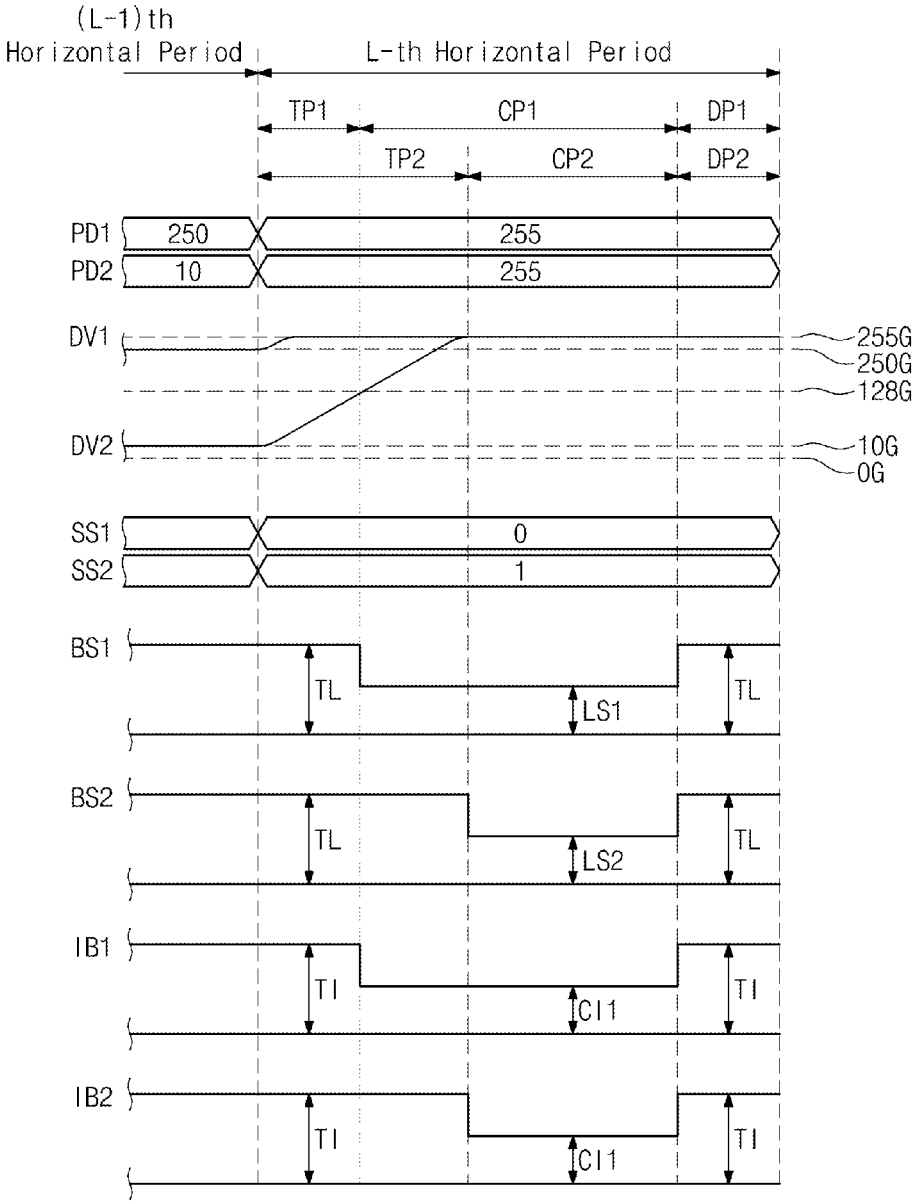
FIG. 12 is a timing diagram of signals shown in FIGS. 5 and 6 according to another exemplary embodiment of the present disclosure.

FIG. 12 is a timing diagram of signals shown in FIGS. 5 and 6 according to another exemplary embodiment of the present disclosure. Hereinafter, the operation of the data driver 300 is exemplarily described below with reference to FIGS. 5, 6 and 12.

The first and second data voltages DV1 and DV2, the first and second pixel image data PD1 and PD2, and the first and second selection signals SS1 and SS2 have been described above with reference to FIG. 10, and thus details thereof are omitted. In addition, the first and second activation multiplexers E-MUX1 and E-MUX2 and the first and second level multiplexers L-MUX1 and L-MUX2 have been described above with reference to FIGS. 5 and 6, and thus details thereof are omitted.

The first bias signal generator BSG1 outputs the transition level value TL when the first selection activation signal SES1 has the low level and selects the first selection control level value SLS1 when the first selection activation signal SES1 has the high level to generate the first bias signal BS1. Accordingly, the first bias signal BS1 has the transition level value TL during the first transition period TP1 and the first dummy period DP1 and has the first control level value LS1 during the first control period CP1.

The second bias signal generator BSG2 outputs the transition level value TL when the second selection activation signal SES2 has the low level and selects the second selection control level value SLS2 when the second selection activation signal SES2 has the high level to generate the second bias signal BS2. Accordingly, the second bias signal BS2 has the transition level value TL during the second transition period TP2 and the second dummy period DP2 and has the second control level value LS2 during the second control period CP2.

The first bias current generating unit BG1 generates the first bias current IB1 based on the first bias signal BS1, and the second bias current generating unit BG2 generates the second bias current IB2 based on the second bias signal BS2.

Accordingly, the first bias current IB1 has the transition current TI during the first transition period TP1 and the first dummy period DP1 and has the first control current CI1 during the first control period CP1. The second bias current IB2 has the transition current TI during the second transition period TP2 and the second dummy period DP2 and has the first control current CI1 during the second control period CP2.

Meanwhile, since the transition current TI is greater than the first and second control currents CI1 and CI2, the power consumption of the first and second buffers BP1 and BP2 when the first and second buffers BP1 and BP2 are biased by the transition current TI is greater than the power consumption of the first and second buffers BP1 and BP2 when the first and second buffers BP1 and BP2 are biased by the first and second control currents CI1 and CI2. In addition, the throughput rate of the first and second buffers BP1 and BP2 when the first and second buffers BP1 and BP2 are biased by the transition current TI is greater than the throughput rate of the first and second buffers BP1 and BP2 when the first and second buffers BP1 and BP2 are biased by the first and second control currents CI1 and CI2.

The first bias current IB1 is applied to the first buffer BP1, and the second bias current IB2 is applied to the second buffer BP2.

Since the transition current TI is applied to the first buffer BP1 during the first transition period TP1 having a shorter duration than that of the second transition period TP2, and the first control current CI1 is applied to the first buffer BP1 during the first control period CP1 having a longer duration than that of the second control period CP2, the power consumption of the first buffer BP1 is more reduced than the power consumption of the second buffer BP2.

In addition, since the transition current TI is applied to the second buffer BP2 during the second transition period TP2 having a longer duration than that of the first transition period TP1, the second buffer BP2 has enough throughput rate to output the second data voltage DV2 even though it is greatly varied.

As described above, each of the first and second bias units BU1 and BU2 selects one of the first and second bias signals BS1 and BS2 in accordance with the first and second pixel image data PD1 and PD2 and outputs the bias current corresponding to the selected one bias signal.

Therefore, the first and second buffers BP1 and BP2 are respectively applied with the first and second bias currents IB1 and IB2 that respectively correspond to the variations in amount of the first and second data voltages DV1 and DV2 and have the throughput rates corresponding to the variations in amount of the first and second data voltages DV1 and DV2. As a result, the power consumption of the first and second buffers BP1 and BP2 may be reduced.

The first and second bias units BU1 and BU2 have been described above as a representative example. Detailed descriptions of the third to n-th bias units BU3 to BUn are omitted since the first to n-th bias units BU1 to BUn have the same structure and function.

Figure 13:
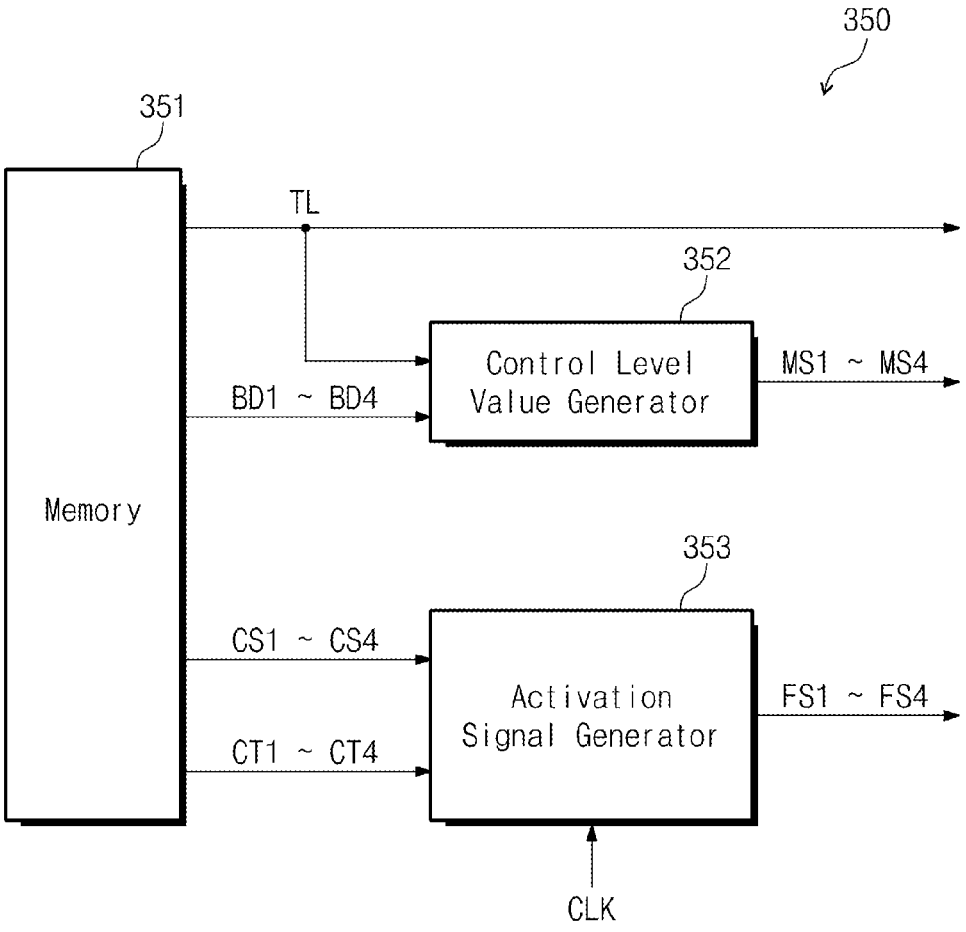
FIG. 13 is a block diagram showing a global setting part according to another exemplary embodiment of the present disclosure.
Figure 14:
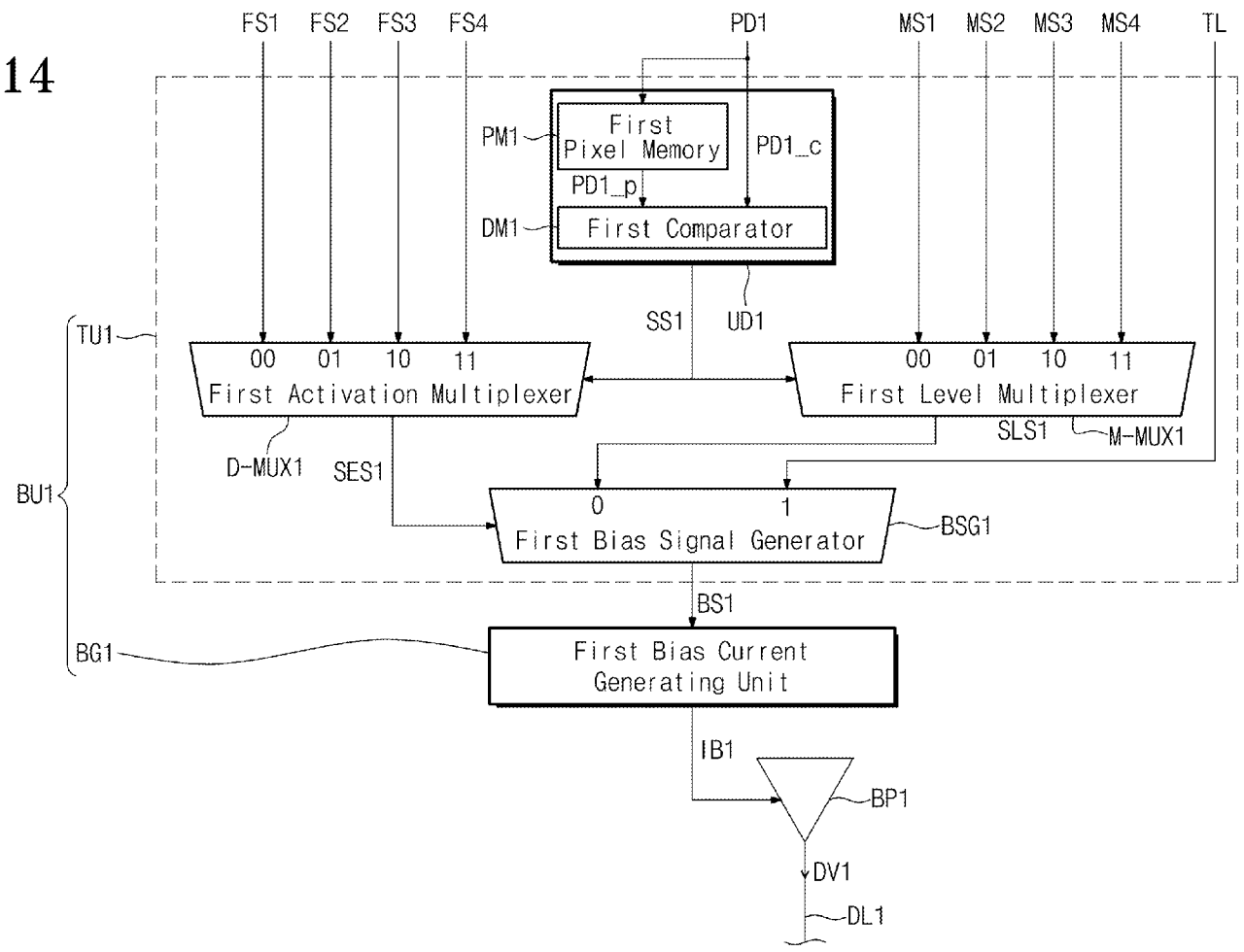
FIG. 14 is a block diagram showing a first bias unit according to another exemplary embodiment of the present disclosure.

FIG. 13 is a block diagram showing a global setting part according to another exemplary embodiment of the present disclosure. FIG. 14 is a block diagram showing a first bias unit according to another exemplary embodiment of the present disclosure.

Referring to FIG. 13, a global setting part 350 generates the transition level value TL, a plurality of control level values, and a plurality of activation signals. As FIG. 13 shows, the control level values are configured to include first to fourth control level values MS1 to MS4, and the activation signals are configured to include first to fourth activation signals FS1 to FS4.

The first to fourth activation signals FS1 to FS4 shown in FIG. 13 have waveforms substantially similar to those of the first and second activation signals ES1 and ES2 described with reference to FIG. 3. In more detail, the first activation signal FS1 has a low level during a first transition period and a first dummy period and has a high level during a first control period. The second activation signal FS2 has a low level during a second transition period and a second dummy period and has a high level during a second control period. The third activation signal FS3 has a low level during a third transition period and a third dummy period and has a high level during a third control period. The fourth activation signal FS4 has a low level during a fourth transition period and a fourth dummy period and has a high level during a fourth control period. Among the first to fourth control periods, at least one control period may be different from the other control periods.

Among the first to fourth control level values MS1 to MS4, at least one control level value may be different from the other control level values.

The global setting part 350 includes the memory 351, the control level value generator 352, and the activation signal generator 353. DELETING IS CORRECT The memory 351 stores first to fourth bias different values BD1 to BD4 including information about differences between the transition level value TL and the first to fourth control level values MS1 to MS4. In addition, the memory 351 stores first to fourth control start time points CS1 to CS4 including information about the start point of the first to fourth control periods and stores first to fourth control end time points CT1 to CT4 including information about the first to fourth control periods.

The control level value generator 352 receives the transition level value TL and the first to fourth bias different values BD1 to BD4 from the memory 351. The control level value generator 352 subtracts each of the first to fourth bias different values BD1 to BD4 from the transition level value TL and generates first to fourth control level values MS1 to MS4.

The activation signal generator 353 receives the clock signal CLK and generates first to fourth activation signals FS1 to FS4 based on the first to fourth control start time points CS1 to CS4 and the first to fourth control end time points CT1 to CT4 to respectively determine the first to fourth control periods. The operation of the activation signal generator 353 is as described above with reference to FIG. 3, and thus details thereof are omitted.

Referring to FIG. 14, the first bias unit BU1 includes the first bias signal generating unit TU1 and the first bias current generating unit BG1. In addition, the first bias signal generating unit TU1 includes a first variation detector UD1, a first activation multiplexer D-MUX1, a first level multiplexer M-MUX1, and the first bias signal generator BSG1.

The first variation detector UD1 receives the first pixel image data PD1 and generates the first selection signal SS1 in accordance with the first pixel image data PD1. The first variation detector UD1 includes the first pixel memory PM1 and a first comparator DM1.

The first comparator DM1 compares the previous first pixel image data PD1_*p* and the present first pixel image data PD1_*c* and generates the first selection signal SS1. As an example, the first comparator DM1 calculates an absolute value of a difference between a previous grayscale value of the previous first pixel image data PD1_*p* and a present grayscale value of the present first pixel image data PD1_*c* and generates the first selection signal SS1 based on the absolute value of the difference between the previous grayscale value of the previous first pixel image data PD1_*p* and the present grayscale value of the present first pixel image data PD1_*c*.

In the exemplary embodiment of FIG. 14, the first comparator DM1 compares the upper 2 bits of the present first pixel image data PD1_*c* and the upper 2 bits of the previous first pixel image data PD1_*p* to generate the first selection signal SS1. Accordingly, the first selection signal SS1 may have four possible values of "00", "01", "10", and "11".

The first level multiplexer M-MUX1 receives the first to fourth control level values MS1 to MS4 from the global setting part 350 and receives the first selection signal SS1 from the first comparator DM1. The first level multiplexer M-MUX1 selects one control level value of the first to fourth control level values MS1 to MS4 in response to the first selection signal SS1 and outputs the selected control level value as the first selection control level value SLS1. For instance, when the first selection signal SS1 has the value of "00", the first level multiplexer M-MUX1 selects the first control level value MS1, and when the first selection signal SS1 has the value of "01", the first level multiplexer M-MUX1 selects the second control level value MS2. In addition, when the first selection signal SS1 has the value of "10", the first level multiplexer M-MUX1 selects the third control level value MS3, and when the first selection signal SS1 has the value of "11", the first level multiplexer M-MUX1 selects the fourth control level value MS4.

The first activation multiplexer D-MUX1 receives the first to fourth activation signals FS1 to FS4 from the global setting part 350 and receives the first selection signal SS1 from the first comparator DM1. The first activation multiplexer D-MUX1 selects one activation signal of the first to fourth activation signals FS1 to FS4 in response to the first selection signal SS1 and outputs the selected activation signal as the first selection activation signal SES1. For instance, when the first selection signal SS1 has the value of "00", the first activation multiplexer D-MUX1 selects the first activation signal FS1, and when the first selection signal SS1 has the value of "01", the first activation multiplexer D-MUX1 selects the second activation signal FS2. In addition, when the first selection signal SS1 has the value of "10", the first activation multiplexer D-MUX1 selects the third activation signal FS3, and when the first selection signal SS1 has the value of "11", the first activation multiplexer D-MUX1 selects the fourth activation signal FS4.

The first bias signal generator BSG1 receives the transition level value TL, the first selection control level value SLS1, and the first selection activation signal SES1. The first bias signal generator BSG1 selects one of the transition level value TL and the first selection control level value SLS1 in response to the first selection activation signal SES1 to generate the first bias signal BS1.

The first bias current generating unit BG1 receives the first bias signal BS1 from the first bias signal generator BSG1 and generates the first bias current IB1 in response to the first bias signal BS1. The first bias current generating unit BG1 applies the first bias current IB1 to the first buffer BP1.

In the exemplary embodiment of FIGS. 13 and 14, the global setting part 350 generates four control level values and four activation signals, and the first bias signal generating unit TU1 selects one control level value of the four control level value and one activation signal of the four activation signals based on the comparison of the upper 2 bits of the previous first pixel image data PD1_*p* and the present first pixel image data PD1_*c*.

However, the global setting part 350 and the first bias signal generating unit TU1 are not limited thereto. The global setting part 350 may generate $2^i$ ("i" is a natural number) control level values and activation signals, and the first bias signal generating unit TU1 may select one of the $2^i$ ("i" is a natural number) control level values and one of the $2^i$ ("i" is a natural number) activation signals based on the comparison of the upper i bits of the previous first pixel image data PD1_*p* and the present first pixel image data PD1_*c*.

As the number of the control level values and the number of the activation signals, which are selected by the first bias signal generating unit TU1, increases, the first bias signal generating unit TU1 generates the bias signal to more precisely correspond to the variation in amount of the first data voltage DV1. Therefore, the first buffer BP1 receives the first bias current IB1 corresponding to the variation in amount of the first data voltage DV1 and has the throughput rate corresponding to the variation in amount of the first data voltage DV1. As a result, the power consumption of the first buffer BP1 may be reduced.

Figure 15:
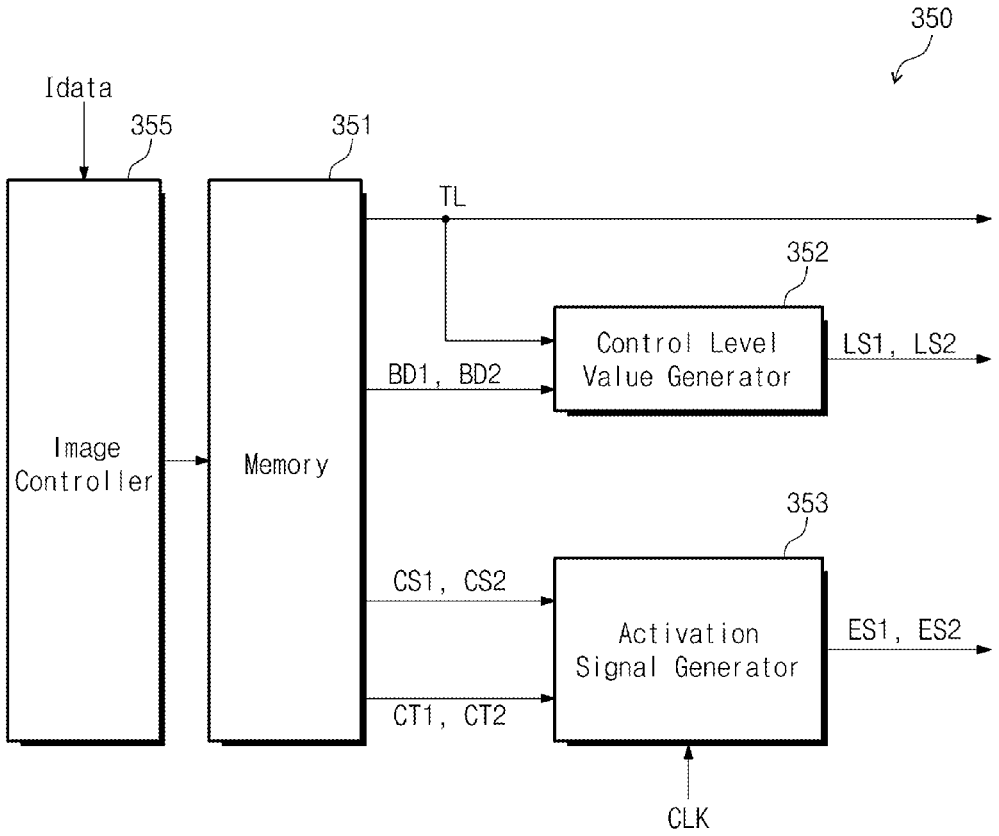
FIG. 15 is a block diagram showing a global setting part according to another exemplary embodiment of the present disclosure.

FIG. 15 is a block diagram showing a global setting part according to another exemplary embodiment of the present disclosure. Referring to FIG. 15, the global setting part 350 includes an image controller 355. The image controller 355 receives the input image data Idata, analyzes the input image data Idata, generates at least one of the transition level value TL, the first and second bias different values BD1 and BD2, the first and second control start time points CS1 and CS2, and the first and second control end time points CT1 and CT2 based on the analyzed result, and applies the generated value to the memory 351.

In more detail, the image controller 355 analyzes the input image data Idata, calculates an average grayscale value of the input image data Idata, and generates at least one of the transition level value TL, the first and second bias different values BD1 and BD2, the first and second control start time points CS1 and CS2, and the first and second control end time points CT1 and CT2 base on the average grayscale value.

In the exemplary embodiment of FIG. 15, the image controller 355 periodically analyzes the input image data every horizontal period and generates at least one of the first and second bias different values BD1 and BD2, the first and second control start time points CS1 and CS2, and the first and second control end time points CT1 and CT2.

As described above, when the global setting part 350 includes the image controller 355, the waveforms of the first and second control level values LS1 and LS2 and the waveforms of the first and second activation signals ES1 and ES2 are determined depending on the input image data Idata.

In the exemplary embodiment of FIG. 15, the image controller 355 serves as a part of the data driver 300, but it should not be limited thereto. According to another embodiment, the image controller 355 may be included in the timing controller 400. In addition, the image controller 355 may be provided in a card or board shape separate from the timing controller 400. In this case, the image controller 355 is disposed between the image source and the timing controller 400 or included in a device connected between the image source and the timing controller 400.

Although the exemplary embodiments of the present system and method are described herein, the present system and method are not limited to these exemplary embodiments. Rather, various changes and modifications may be made by one ordinary of skill in the art without departing from the spirit and scope of the present system and method.

What is claimed is:

1. A data driver comprising:

a plurality of buffers that respectively output data voltages corresponding to pixel image data;

a plurality of bias units that correspond to the buffers in a one-to-one correspondence and drive the buffers, respectively; and a global setting part that applies a plurality of control level values to the bias units, and further applies a plurality of activation signals to the bias units, the plurality of activation signals each defining a transition period and a control period, wherein each of the bias units comprises:

a bias signal generating unit that selects one control level value among the control level values and one activation signal among the plurality of activation signals based on a corresponding pixel image data among the pixel image data and generates a bias signal having a transition level value during the transition period of the selected activation signal and having the selected control level value during the control period of the selected activation signal; and a current generating unit that generates a corresponding bias current in response to the bias signal and applies the corresponding bias current to a corresponding buffer among the buffers.

2. The data driver of claim 1, further comprising:

a sampling latch that receives input image data and samples the pixel image data from the input image data in response to a sampling signal; and a digital-to-analog converter that converts the pixel image data to the data voltages and respectively applies the data voltages to the buffers, wherein the bias signal generating unit receives the corresponding pixel image data from the sampling latch among the pixel image data.

3. The data driver of claim 2, wherein the bias signal generating unit comprises a variation detector, an activation multiplexer, a level multiplexer, and a bias signal generator, the variation detector receives the corresponding pixel image data and generates a selection signal based on the corresponding pixel image data, the activation multiplexer selects one activation signal among the activation signals in response to the selection signal and outputs the selected activation signal as a selection activation signal, the level multiplexer selects one control level value among the control level values in response to the selection signal and outputs the selected control level value as a selection control level value, and the bias signal generator selects the transition level value during the transition period of the selected activation signal in response to the selection activation signal and selects the selected control level value during the control period of the selected activation signal in response to the selection activation signal to generate the bias signal.

4. The data driver of claim 3, wherein the control periods and the transition periods are provided in every horizontal period.

5. The data driver of claim 4, wherein the transition periods precede the control periods in the horizontal period and the transition level value is greater than the control level value.

6. The data driver of claim 3, wherein the corresponding pixel image data of the pixel image data comprises a previous pixel image data provided in an (L−1)th horizontal period and a present pixel image data provided in an L-th horizontal period, and the variation detector comprises:

a pixel memory that stores the previous pixel image data; and a comparator that calculates an absolute value of a difference between a previous grayscale value of the previous pixel image data and a present grayscale value of the present pixel image data and generates the selection signal in accordance with the calculated absolute value.

7. The data driver of claim 6, wherein the comparator compares upper i ("i" is a natural number) bits of the previous pixel image data and upper i bits of the present pixel image data to generate the selection signal, and there are 2i number of each of the control level values and the activation signals.

8. The data driver of claim 7, wherein i is equal to 1 and the comparator receives the previous pixel image data and the present pixel image data and performs an exclusive-OR calculation on the previous pixel image data and the present pixel image data.

9. The data driver of claim 2, wherein the global setting part comprises a control level value generator that subtracts each of bias different values from the transition level value to generate the control level values.

10. The data driver of claim 9, wherein the global setting part further comprises a activation signal generator that generates the activation signals based on control start time points having information about start points of the control periods and control end time points having information about end points of the control periods.

11. The data driver of claim 10, wherein the global setting part further comprises an image controller that receives the input image data, analyzes the input image data, and generates at least one of the transition level value, the bias different values, the control start time points, and the control end time points based on the analyzed result.

12. The data driver of claim 11, wherein the image controller analyzes the input image data every horizontal period and generates at least one of the transition level value, the bias different values, the control start time points, and the control end time points.

13. A method of driving a data driver, comprising:

outputting a plurality of data voltages corresponding to pixel image data through a plurality of buffers, respectively;

driving the buffers using a plurality of bias units that correspond to the buffers in a one-to-one correspondence;

applying a plurality of control level values to the bias units; and applying a plurality of activation signals to the bias units, the plurality of activation signals each defining a transition period and a control period;

wherein driving the buffers comprises:

selecting one control level value among the control level values and one activation signal among the activation signals based on a corresponding pixel image data among the pixel image data;

generating a bias signal having a transition level value during the transition period of the selected activation signal and having the selected control level value during the control period of the selected activation signal;

generating a bias current in response to the bias signal; and applying the bias current to a corresponding buffer among the buffers.

14. A display device comprising:

a display panel configured to output a pixel image data; and a data driver configured to output a plurality of data voltages to the display panel, wherein the data driver comprises:

a plurality of buffers that respectively output the data voltages corresponding to the pixel image data;

a plurality of bias units that correspond to the buffers in a one-to-one correspondence and drive the buffers, respectively; and a global setting part that applies a plurality of control level values to the bias units, and further applies a plurality of activation signals to the bias units, the plurality of activation signals each defining a transition period and a control period, wherein each of the bias units comprises:

a bias signal generating unit that selects one control level value among the control level values and one activation signal among the plurality of activation signals based on a corresponding pixel image data among the pixel image data and generates a bias signal having a transition level value during the transition period of the selected activation signal and having the selected control level value during the control period of the selected activation signal; and a current generating unit that generates a corresponding bias current in response to the bias signal and applies the corresponding bias current to a corresponding buffer among the buffers.

* * * * *